US008162676B1

(12) United States Patent
Hsieh et al.

(10) Patent No.: US 8,162,676 B1
(45) Date of Patent: Apr. 24, 2012

(54) ELECTRONIC DEVICE HAVING EXTERNAL CONNECTOR

(75) Inventors: Ming-Chih Hsieh, New Taipei (TW); Tsung-Hsi Li, New Taipei (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/172,833

(22) Filed: Jun. 30, 2011

(30) Foreign Application Priority Data

Mar. 31, 2011 (TW) ..... 100111181

(51) Int. Cl.
*H01R 12/00* (2006.01)

(52) U.S. Cl. ..... 439/76.1

(58) Field of Classification Search ..... 439/76.1, 439/85, 557, 377, 357, 350, 352
See application file for complete search history.

(56) References Cited

U.S. PATENT DOCUMENTS

| | | | | |
|---|---|---|---|---|
| 6,095,855 | A * | 8/2000 | Iwata et al. | 439/553 |
| 6,241,551 | B1 * | 6/2001 | Watanabe | 439/557 |
| 7,755,906 | B2 * | 7/2010 | Sato | 361/747 |
| 2004/0094328 | A1 * | 5/2004 | Fjelstad et al. | 174/251 |

* cited by examiner

*Primary Examiner* — Tulsidas C Patel
*Assistant Examiner* — Phuongchi Nguyen
(74) *Attorney, Agent, or Firm* — Altis Law Group, Inc.

(57) ABSTRACT

An electronic device includes a shell, a connector, a PCB and a pin header. The connector is mounted on the shell and includes an external connection terminal inside the shell and an internal connection terminal inside the shell and connected to the external connection terminal. The PCB is received in the shell and defines a number of vias. Two ends of the pin header respectively detachably fit into the internal connection terminal and the vias.

6 Claims, 3 Drawing Sheets

ELECTRONIC DEVICE HAVING EXTERNAL CONNECTOR

BACKGROUND

1. Technical Field

The present disclosure relates to electronic devices and, particularly, to an electronic device facilitating a connection between an external connector and an internal printed circuit board (PCB) thereof.

2. Description of Related Art

IP cameras have cables. The cables include a male connector. Computers include a shell, a PCB, and a female connector. The PCB is received in the shell. The female connector is mounted in the shell and is directly soldered on the PCB or connected to the PCB via conductive threads. Thus, after the male connector is plugged into the female connector, the IP cameras are electrically connected to the computers via the connection between the male connector and the female connector. However, if the female connector is directly soldered on the PCB, it is not beneficial for the repair of the computers if the female connector is damaged, as it is difficult to detach the soldered female connector from the PCB. If the female connector is connected to the PCB via the conductive threads, the connection process of the conductive threads is inconvenient and will result in an insufficient assembly process.

Therefore, it is desirable to provide an electronic device, which can overcome the limitations described.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION

Embodiments of the present disclosure will now be described in detail with reference to the drawings.

Figure 1:
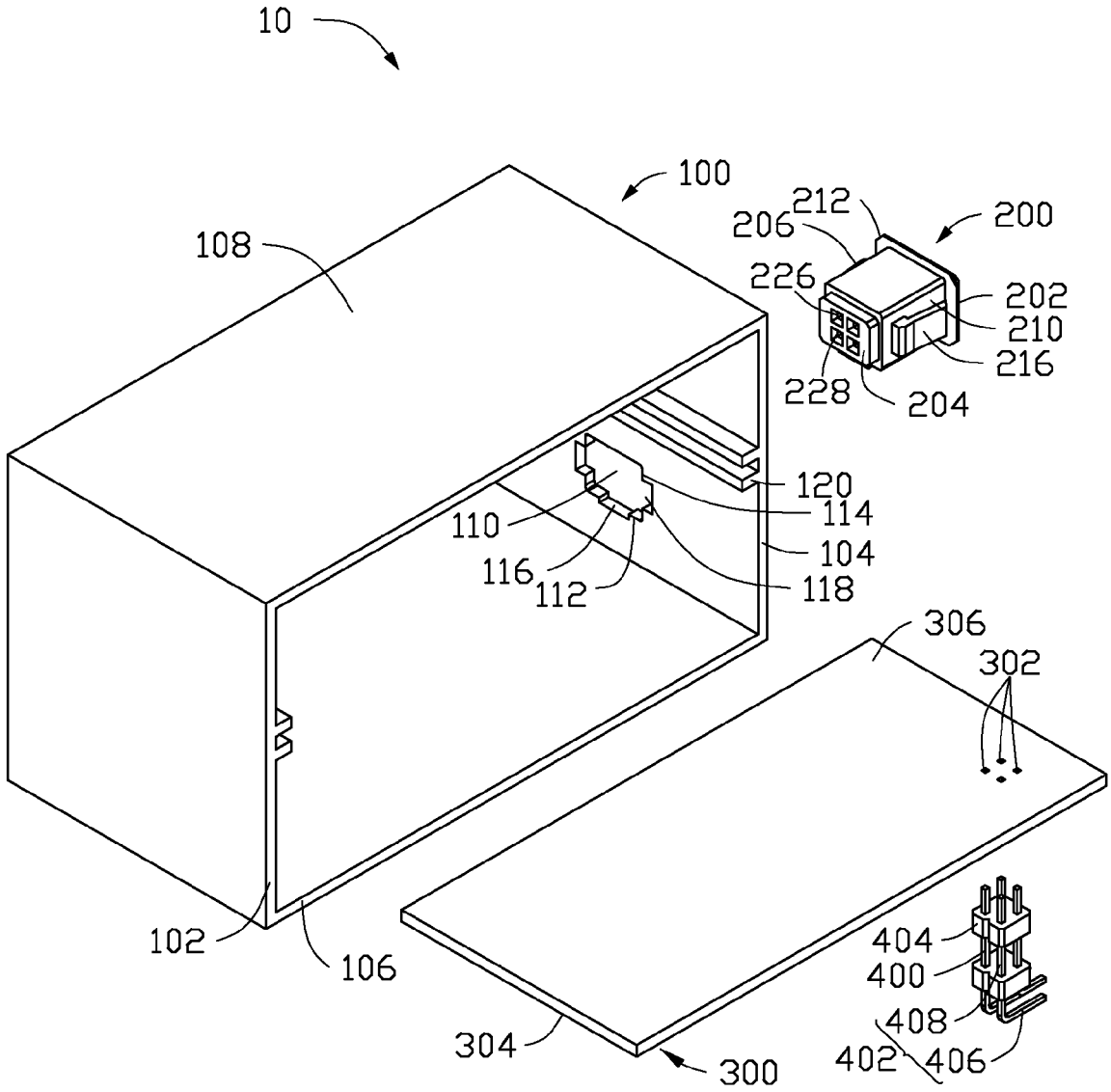
FIG. 1 is an isometric, exploded, and schematic view of an electronic device, according to an embodiment.
Figure 2:
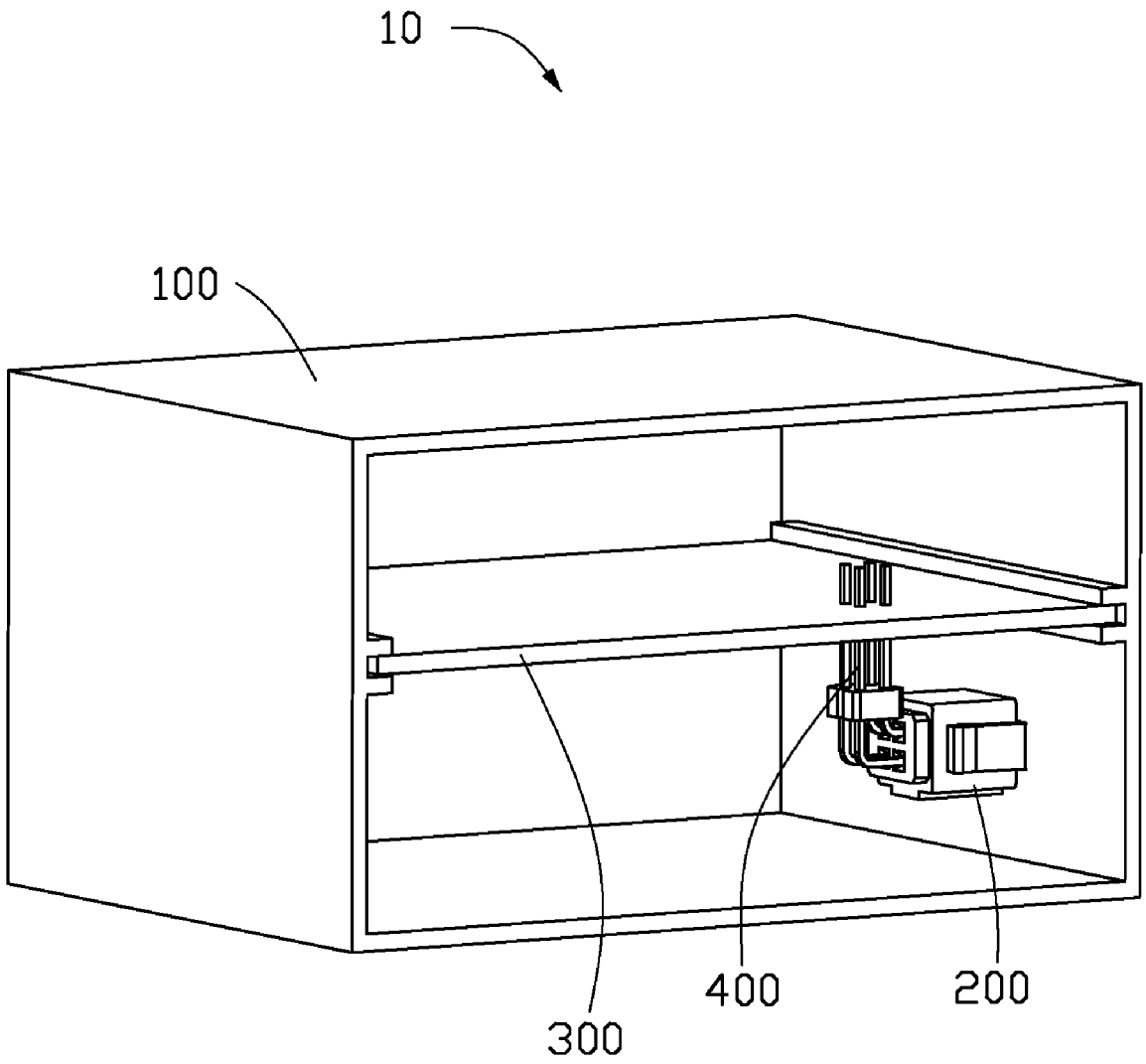
FIG. 2 is an isometric, assembled, and schematic view of the electronic device of FIG. 1.

Referring to FIGS. 1 and 2, an electronic device 10, according to an embodiment, includes a shell 100, a connector 200 mounted in the shell 100, a PCB 300 received in the shell 100, and a pin header 400 connecting the connector 200 to the PCB 300. The connector 200 includes an external connection terminal 202 and an internal connection terminal 204. The external connection terminal 202 is exposed to and configured for connecting to an external connector (not shown), that is, the external connection terminal 202 is located outside the shell 100. The internal connection terminal 204 is positioned inside the shell 100 and electrically connects to the external connection terminal 202. The PCB 300 defines a number of vias 302, which are configured for connecting the internal connection terminal 204. One end of the pin header 400 is detachably fitted into the internal connection terminal 204 and the other end of the pin header 400 is detachably fitted into the vias 302, thus connecting the connector 200 and the PCB 300. Therefore, the PCB 300 can communicate with the connector 200 via the pin header 400.

Apparently, the utilization of the pin header 400 not only facilitates the assembly process of the electronic device 10 as the connection process of conductive threads which is conventionally used to connect the connector 200 to the PCB 300 is omitted but also facilitates the repairing of the electronic device 10 when the connector 200 is damaged because that the connector 200 is detachably connected to pin header 400.

The electronic device 10 can be, for example, a computer for connecting to IP cameras.

The shell 100 includes a front panel 102 which typically users face when using the electronic device 10, a back panel 104 opposite to and substantially parallel to the front panel 102, a bottom plate 106 perpendicularly connecting the front panel 102 and the back panel 104, and a top plate 108 opposite to and substantially parallel to the bottom plate 106. The front panel 102, the back panel 104, the bottom plate 106, and the top plate 108 cooperatively define a receiving space (not labeled). The back panel 104 defines a generally rectangular through hole 110. The through hole 110 is bounded by a bottom sidewall 112 which is substantially parallel to the bottom plate 106 and two lateral sidewalls 114 perpendicularly connecting the bottom sidewall 112 and substantially perpendicular to the front panel 102 and the back panel 104. The back panel 104 also defines a guiding groove 116 generally in a middle portion of the bottom sidewall 112 and an engagement groove 118 generally in a middle portion of each lateral sidewall 114. Both the guiding groove 116 and the engagement grooves 118 extend through the back panel 104 along the widthwise direction of the back panel 104, that is, the guiding groove 116 and the engagement grooves 118 extend through the through hole 110. Both the front panel 102 and the back panel 104 include a PCB holder 120, which directly faces each other. The PCB holders 120 are elongated, extend along a direction substantially parallel to the bottom plate 106, and are aligned with each other. The PCB holder 120 on the back panel 104 is located between the through hole 110 and the top plate 108, slightly adjacent to the through hole 110.

Figure 3:
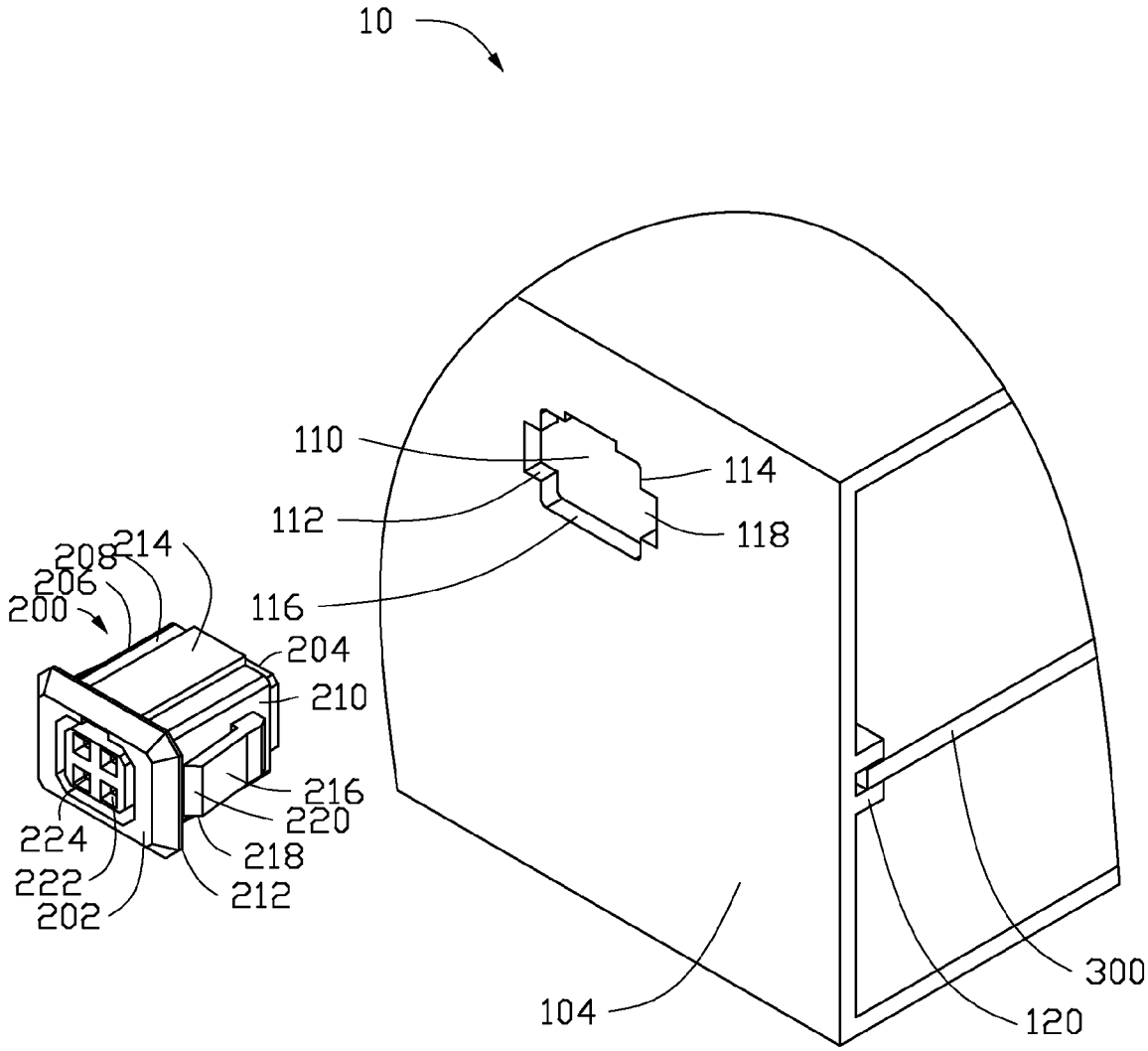
FIG. 3 is a partial, isometric, enlarged, and schematic view of the electronic device of FIG. 1 which is viewed at another angle.

Also referring to FIG. 3, the connector 200 comprises a substantially rectangular cylinder body 206. The external connection terminal 202 and the internal connection terminal 204 are two terminals of the body 206. The body 206 is shaped to fit into the through hole 110. In particular, the body 206 includes a bottom surface 208 and two lateral surfaces 210 perpendicularly connecting the bottom surface 208. The connector 200 also includes a sealing ring 212, which extends outward from the cylindrical surface of the body 206, adjacent to the external connection terminal 202, and is configured for sealing the through hole 110 after the body 206 fitted into the through hole 110, that is, the size of the sealing ring 212 is larger than that of the through hole 110. The connector 200 also includes a guiding block 214 which extends upward from a middle portion of the bottom surface 208 and corresponds to the guiding groove 116. The guiding block 214 extends from the internal connection terminal 204 to the sealing ring 212. The connector 200 also includes two engagement pieces 216, which are made of elastic material. Each engagement piece 216 extends upward from a corresponding lateral surface 210, adjacent to the internal connection terminal 204, and is bent towards the external connection terminal 202 slightly less than 90 degrees, forming a free end 218 far away from the internal connection terminal 204 but adjacent to the external connection terminal 202. The distance between each free end 218 and the sealing ring 212 is shorter than the depth of the through hole 110 (i.e., the width of the back panel 104). Each free end 218 forms a slant surface 220, which slants from a far-end towards a near-end of the body 206 and from the internal connection terminal 204 towards the external connection terminal 202.

In this embodiment, the external connection terminal 202 defines a number of first pin holes 222, which are configured for connecting to an external male connector. Each first pin hole 222 receives a first terminal 224. The internal connection terminal 204 also defines a number of second pin holes 226 corresponding to the pin header 400. Each second pin hole 226 receives a second terminal 228 connected to a corresponding first terminal 224. In other embodiments, the external connection terminal 202 can include a number of pins (not shown), which are configured for connecting to an external female connector. Each second terminal 228 is connected to a corresponding pin.

The PCB 200 includes a front edge 304 and a back edge 306. The front edge 304 is shaped to be snuggly held by the PCB holder 120 on the front panel 102. The back edge 306 is shaped to be snuggly held by the PCB holder 120 on the back panel 104.

The pin header 400 includes a number of pins 402 and two assembly plates 404. The pins 402 are combined by the assembly plates 404. Each pin 402 includes a first section 406 and a second section 408 substantially perpendicular to the first section 406. The pins 402 are arranged such that the first sections 406 are substantially parallel to each other and the second sections 408 are also substantially parallel to each other. Each first section 406 fits into a corresponding second pin hole 226. Each second section 408 passes through the two assembly plates 404 and fits into a corresponding via 302.

In assembly, the PCB 300 is placed into the shell 100. The front edge 304 and the back edge 306 are respectively held by the PCB holders 120. Thus, the PCB 300 is secured to the shell 100. The body 206 is inserted, via the internal connection terminal 204, into the through hole 110 such that the guiding block 214 slides along the guiding groove 116 to ensure that the body 206 is inserted in a proper orientation. The engagement pieces 216 slide in the respective engagement grooves 118 and is further bent towards the body 206, thus tightly pressing the bottom surface of the back panel 104, until the slanted surfaces 220 slide into the through hole 110. After the slanted surface 220 slides into the through hole 110, the engagement pieces 216 restores until the sealing ring 212 abuts the back panel 104. Thus, the connector 200 is mounted in the back panel 104 by the sealing ring 212 and the engagement pieces 216 (i.e., the slanted surfaces 220). Finally, two ends of the pin header 400 detachably fit into the second pin holes 226 and the vias 302 respectively.

In this embodiment, most of the body 206 can be inserted into the through hole 110 since the sealing ring 212 is positioned at the external connection terminal 202. In other embodiments, the sealing ring 212 can be located on another portion of the body 206 to expose more portions of the body 206. The configuration of the sealing ring 212 is also not limited to this embodiment, but can conform to other configurations that can seal the through hole 110 depending on need. In further alternative embodiments, the sealing ring 212 can be omitted.

The guiding groove 116 can be defined in other appropriate positions in the through hole 110, for example, other surfaces which bound the through hole 110. The guiding block 214 can be relocated corresponding to the guiding groove 116. The guiding groove 116 and the guiding block 214 can take other forms in other embodiments, provided that the guiding groove 116 and the guiding block 214 are utilized to ensure the body 206 is inserted into the through hole 110 in the proper direction. In further embodiments, other methods can be used to ensure the body is inserted in the proper direction and thus the guiding groove 116 and the guiding block 214 can be omitted.

The engagement grooves 118 and the engagement pieces 216 can be repositioned and can take other forms that can provide slidably engagement between the body 206 and the through hole 110 depending on the need in the other embodiments. For example, in another embodiment, only one engagement groove 118 and one engagement piece 216 can be used. Moreover, in other embodiments, other methods can be used to secure the body 206 to the through hole 110 and the engagement grooves 118 and the engagement pieces 116 can be omitted.

The body 206 and the through hole 100 is not limited to this embodiment too but can be changed depending on need in other embodiments.

It will be understood that the above particular embodiments are shown and described by way of illustration only. The principles and the features of the present disclosure may be employed in various and numerous embodiment of the present disclosure without departing from the scope of the disclosure as claimed. The above-described embodiments illustrate the scope of the disclosure but do not restrict the scope of the disclosure.

What is claimed is:

1. An electronic device, comprising:

a shell;

a connector mounted on the shell, the connector comprising an external connection terminal outside the shell and an internal connection terminal inside the shell and connected to the external connection terminal;

a PCB received in the shell and defines a plurality of vias; and a pin header, one end of the pin header detachably fitting into the internal connection terminal, and another end of the pin header detachably fitting into the vias;

wherein the shell defines a through hole that is bounded by a first surface, the shell further defines an engagement groove in the first surface and extending through the through hole, the connector comprises a cylindrical body fitting into the through hole, the cylindrical body comprises a cylindrical surface that comprises a second surface corresponding to the first surface, the connector further comprises an elastic engagement piece extending upward from the second surface, adjacent to the internal connection terminal, and bent towards the external connection terminal less than 90 degrees, the engagement piece comprises a free end distal from the internal connection terminal, the free end contacts a bottom surface of the engagement groove.

2. The electronic device of claim 1, wherein the shell defines a through hole, the connector comprises a cylindrical body, the external connection terminal and the internal connection terminal are two terminals of the body, the body fits into the through hole, the connector comprises a sealing ring extending upwards from the cylindrical surface of the body, the sealing ring seals the through hole.

3. The electronic device of claim 2, wherein the sealing ring is positioned adjacent to the external connection terminal.

4. The electronic device of claim 1, wherein the shell defines a through hole that is bounded by a first surface, the shell further defines a guiding groove in the first surface and extending through the through hole, the connector comprises a cylindrical body, the cylindrical body fittingly slides into the through hole and comprises a cylindrical surface, the cylindrical surface comprises a second surface corresponding to the first surface, the connector also comprises a guiding block extending upward from the second surface and sliding in the guiding groove to guide the body to slide through the through hole.

5. The electronic device of claim 4, wherein the connector comprises a sealing ring extending upward from the cylindrical surface of the body and sealing the through hole, the guiding block extends from the internal connection terminal to the sealing ring.

6. The electronic device of claim 1 wherein the connector comprises a sealing ring extending upward from the cylindrical surface of the body and sealing the through hole, the distance between the sealing ring and the free end is shorter than the depth of the through hole, the free end comprises a slant surface slanting from the internal connection terminal to the external connection terminal.

* * * * *